United States Patent [19]

Schmidt

[11] 4,274,159

[45] Jun. 23, 1981

[54] WATERPROOF ZIPPER

[76] Inventor: Robert Schmidt, 314 Fourth St., Saddle Brook, N.J. 07662

[21] Appl. No.: 152,259

[22] Filed: May 22, 1980

[51] Int. Cl.[3] ..... A41D 13/00

[52] U.S. Cl. ..... 2/2; 2/227; 36/4

[58] Field of Search ..... 2/234, 2.1 R, 2.1 A, 2/2, 227; 128/295, 294; 36/4

[56] References Cited

U.S. PATENT DOCUMENTS 2,570,019 10/1951 Wolk ..... 2/82 X

*Primary Examiner*—H. Hampton Hunter

*Attorney, Agent, or Firm*—Mel K. Silverman

[57] ABSTRACT

The present invention discloses a waterproof relief outlet in a chest wader. A waterproof folded funnel having a pair of inner flanges at one end is secured through a center seam of the chest wader. A funnel housing having an inner flap and an outer flap is attached to a back side of the center seam of the chest wader in conjunction with the inner flanges of the funnel. An interlocking tongue is also provided with the inner and outer flaps of the funnel housing. A wearer of the chest wader can relieve his pressure by unlocking the interlocking tongue and unfolding the inner and outer flaps of the housing through which the folded funnel is extended and unfolded.

2 Claims, 6 Drawing Figures

FIG. 1
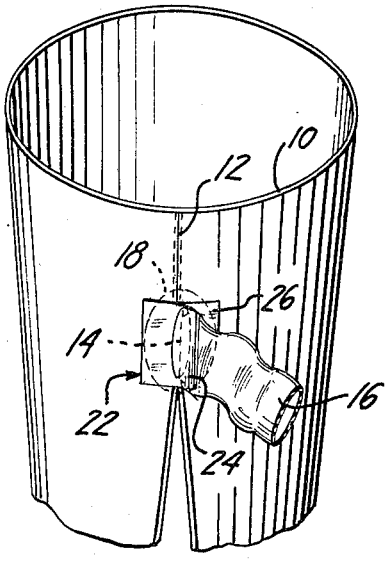
FIG. 2
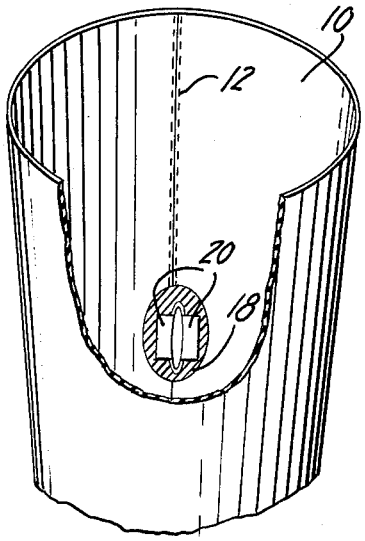
FIG. 3
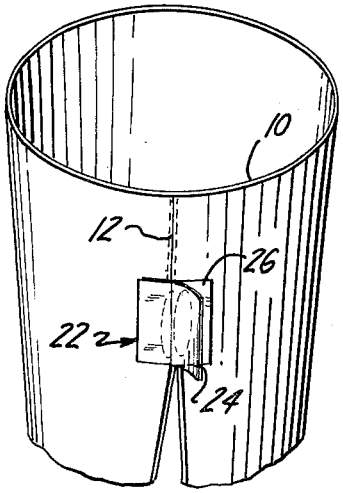
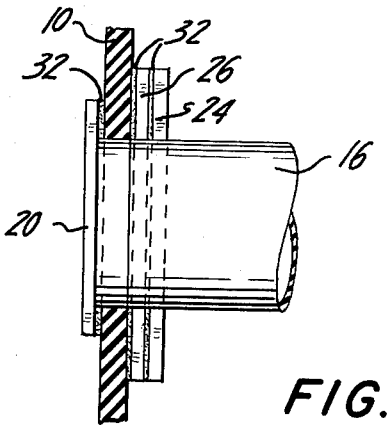
FIG. 5
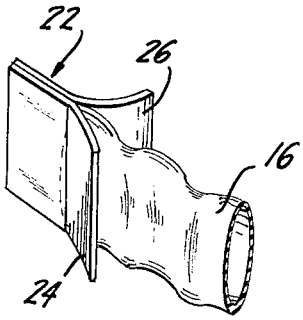
FIG. 6
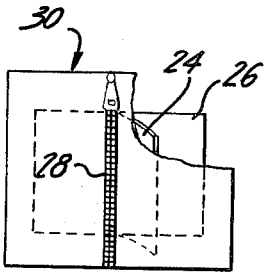
FIG. 4

WATERPROOF ZIPPER

BACKGROUND OF THE INVENTION

This invention relates to a new and improved sportswear. More particularly, the invention relates to an improvement in a chest wader used by persons enjoying the hobby of fishing.

Chest waders are rubber boots that are stepped into and are pulled up to the chest of a person wearing it and they are held up by suspenders. They are known to be used by surf fishermen, stream fishermen, duck hunters, etc. These waders are not provided with any relief outlet. Therefore, a person has to disrobe of all top outerwear and the waders to relieve himself. This causes an inconvenience for a person wearing it.

Accordingly, the present invention can be viewed as an effort to fill a long felt need for a waterproof relief outlet in the chest waders.

SUMMARY OF THE INVENTION

The present invention discloses a waterproof relief outlet in a chest wader. A waterproof folded funnel having a pair of inner flanges at one end is secured through a center seam of the chest wader. A funnel housing having an inner flap and an outer flap is attached to the outside of the center seam of the chest wader. An interlocking tongue is also provided with the inner and outer flaps of the funnel housing. A wearer of the chest wader can relieve his pressure by unlocking the interlocking tongue and unfolding the inner and outer flaps of the housing through which the folded funnel is extended and unfolded.

It is, therefore, an object of this invention to provide an improved chest wader having a waterproof relief outlet not heretofore attainable.

BRIEF DESCRIPTION OF THE DRAWINGS

FIG. 1 is a front view of a chest wader with a folded funnel.

FIG. 2 is a back view of a chest wader.

FIG. 3 is a front view of a chest wader illustrating an outerflap of a funnel housing.

FIG. 4 is a cross-sectional view of a chest wader illustrating a zipper arrangement.

FIG. 5 is a cross-sectional view of a chest wader illustrating an arrangement of an inner flap and an outer flap of a funnel housing.

FIG. 6 is a cross-sectional view of a funnel housing having a folded and extended funnel.

DETAILED DECRIPTION OF THE INVENTION

As shown in FIG. 1, a vertical slit 14, approximately 4", is cut on a center seam 12 of a chest wader 10. A waterproof foldable tubular funnel 16 is passed through the slit 14 and attached to a backside of the wader 10 as shown in FIG. 2. The funnel 16 has a pair of flanges 20 approximately 2" in length made of soft plyable rubber as the funnel itself. The pair of flanges 20 is cemented to the inside surface of the wader as shown in FIGS. 2 and 5. The cemented area 18 is elliptical in cross-section as shown in FIG. 2. The funnel 16 has a plurality of folds and same can be folded to rest along the outer surface of the chest wader 10.

A funnel housing 22 having an outer flap 24 and an inner flap 26 covers the funnel 16 in an folded position as shown in FIG. 3. The inner flap 26 and the outer flap 24 are also attached to the outside surface of the wader by the use of cementing sealant 32 as shown in FIG. 5. As shown in FIG. 6, the folded funnel 16 is extended through the funnel housing 22. The outer flap 24 and the inner flap 26 of the funnel housing 22 are held in their closed position by an interlocking tongue 28 attached thereto. The interlocking tongue or zipper is contained in the cover 30 attached to the housing. A width of the outer flap 24 is shortened to barely overlap the inner opening as shown in FIG. 4. A wearer of the chest wader can relieve his pressure by unlocking the interlocking tongue and unfolding the inner and outer flaps of the funnel housing through which the folded funnel is extended unfolded. This feature provides a great convenience to a person using the chest wader or some kind of water-related outerwears.

Accordingly, while there have been shown and described the preferred embodiments of the present invention, it will be understood that the invention may be embodied otherwise than as herein specifically illustrated or described and that within said embodiments certain changes in the detail and construction, and the form of arrangement of the parts may be made without departing from the underlying idea or principles of this invention within the scope of the appended claims.

What is claimed is:

1. A waterproof relief outlet in a chest wader, comprising:

(a) a waterproof foldable tubular funnel, sealably attached to the wader in the vicinity of the wader crotch;

(b) a funnel housing;

(c) means for restraining the tubular funnel in a fluid-tight folded condition;

whereby a wearer of the chest wader can relieve himself by removing the restraining means and unfolding the tubular funnel to project out of the housing.

2. The relief outlet in accordance with claim number 1 wherein the means for restraining the folded tubular funnel is a pair of overlapping flaps with a zippered cover, all attached to the chest wader at the funnel housing.

* * * * *